United States Patent [19]

Kaga

[11] 4,236,718

[45] Dec. 2, 1980

[54] AMUSEMENT DEVICE

[75] Inventor: Takashi Kaga, Tokyo, Japan

[73] Assignee: Tomy Kogyo Co., Inc., Japan

[21] Appl. No.: 755,946

[22] Filed: Dec. 30, 1976

[30] Foreign Application Priority Data

Jan. 22, 1976 [JP] Japan ..... 51-6189[U]

[51] Int. Cl.[3] ..... A63F 9/06

[52] U.S. Cl. ..... 273/153 R; 46/240; 273/1 M

[58] Field of Search ..... 273/153 R, 86 B, 1 M; 46/240

[56] References Cited

U.S. PATENT DOCUMENTS

| | | | |
|---|---|---|---|
| 2,663,967 | 12/1953 | Mathis | 46/240 |
| 3,253,364 | 5/1961 | Hinkson | 46/240 |
| 3,712,617 | 1/1973 | Ohlschlager | 273/153 R |
| 3,785,648 | 1/1974 | Kobayashi | 46/240 X |
| 3,937,469 | 2/1976 | Cohen | 273/86 B |
| 3,986,296 | 10/1976 | Hamano | 273/86 B |

FOREIGN PATENT DOCUMENTS

| | | | |
|---|---|---|---|
| 669167 | 3/1952 | United Kingdom | 46/240 |

*Primary Examiner*—Anton O. Oechsle
*Attorney, Agent, or Firm*—Staas & Halsey

[57] ABSTRACT

An amusement device having a playing surface provided with a tortuous path along which an object provided with a magnet moves, intersecting members positioned below the playing surfaces and mounted to move in directions perpendicular to each other, a magnet provided at the intersection of the members to attract the magnet of the object, and control mechanisms for moving each of the members.

1 Claim, 5 Drawing Figures

AMUSEMENT DEVICE

BACKGROUND AND SUMMARY OF THE INVENTION

The amusement device of the present invention relates generally to the category of games in which a magnet is used to attract and guide an object along a playing surface. In the present invention, there is provided a playing surface along which a tortuous path is defined, an object for movement along the path which is provided with a magnet, and a mechanism located below the playing surface for independently moving a magnet along two axes, and combining these axial movements when desired, to move the magnet and the object attracted thereby along the tortuous path.

DESCRIPTION OF THE PREFERRED EMBODIMENT

Figure 1:
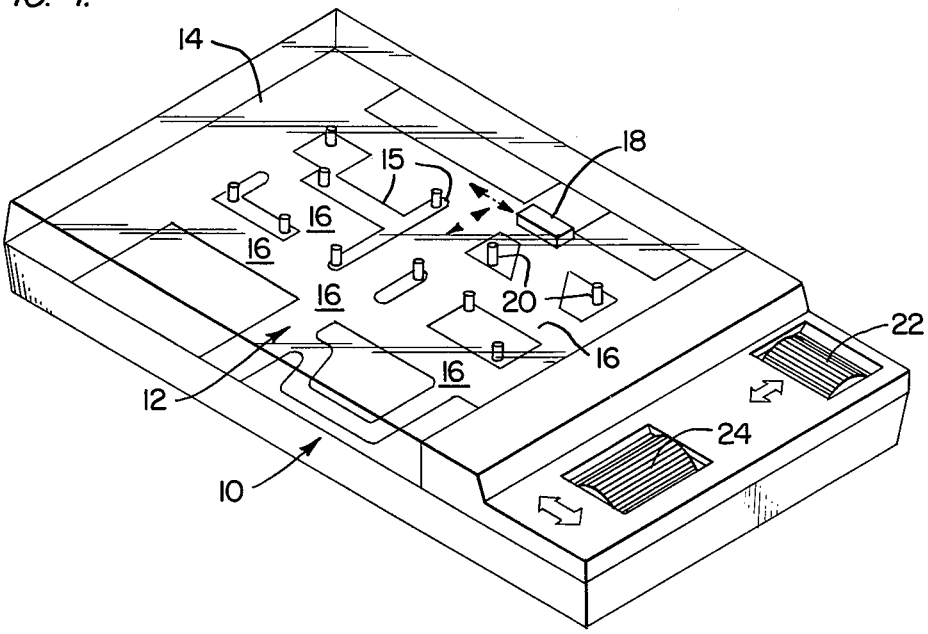
FIG. 1 is a perspective view of the amusement device of the present invention, illustrating the playing surface along which a tortuous path is defined, the object to which a magnet is secured which moves along the path, and the two manually operated control knobs for moving a magnet mechanism positioned below the playing surface.

As illustrated in FIG. 1, the amusement device of the present invention consists of a casing 10 within which the working mechanisms are mounted, a playing surface 12 formed at the top thereof, and a transparent cover 14 surrounding the playing surface 12.

The playing surface 12 is provided with indicia 15 defining a path 16 along which the object 18 moves. A plurality of posts 20 extend downwardly from the transparent cover 14 to the vicinity of the playing surface 12 to provide obstacles more clearly defining the path 16. Exposed through the casing 10 are control knobs 22 and 24 which, as explained in detail hereinafter, are used to direct the object 18.

Figure 2:
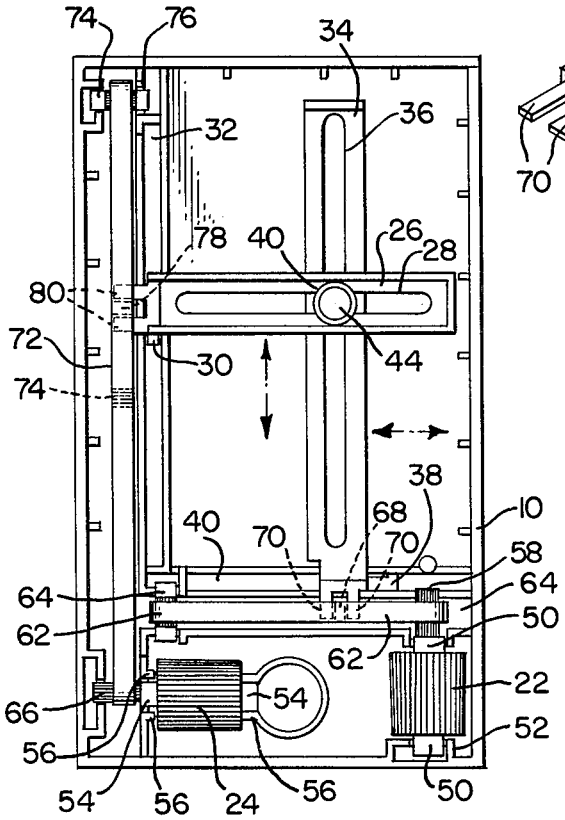
FIG. 2 is a top plan view of the amusement device with the top of the casing thereof removed so as to expose the two moveable, intersecting members to which the magnet is attached and the operating mechanisms for moving the members, either independently or in conjunction with each other, to move the magnet associated therewith below the playing surface to direct the object along the tortuous path of the playing surface.

Turning now to FIG. 2, it will be apparent that a first member designated by the reference numeral 26 is provided with a longitudinal slot 28 and flanges 30 at each end thereof. One of the flanges 30 rests within a slot 32 formed within the casing 10 permitting the member 26 to slide up and down within the casing 10, as illustrated in FIG. 2. In similar manner, the other member 34 is provided with a longitudinal groove 36, and terminates in flanges 38, one of which rests within a groove 40 formed within the casing 10 permitting the second member 34 to slide from side to side within the casing 10, as illustrated in FIG. 2.

Figure 3:
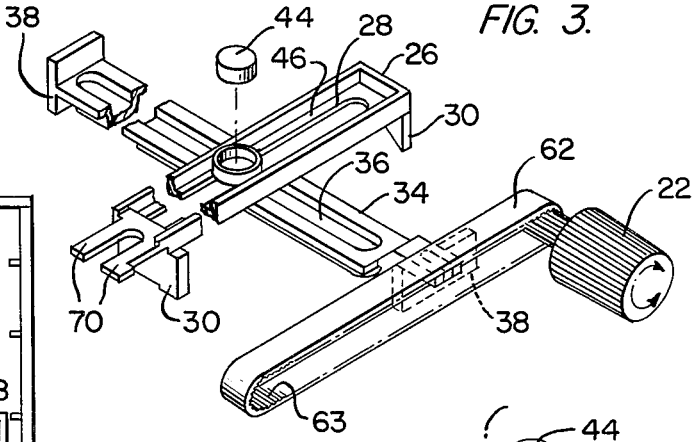
FIG. 3 is an enlarged perspective view of portions of the intersecting members and the magnet attached thereto, and one of the manually operable control mechanisms for rotating a band to which the member is attached to move the member.
Figure 5:
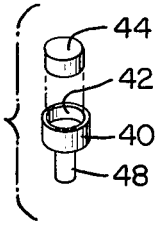
FIG. 5 is a perspective view of the element which holds the magnet and which passes through the slot within one of the intersecting members into a groove provided in the other of the members permitting the members to move independently of each other.

An element designated by the reference numeral 40, as illustrated in FIGS. 3 and 5, is provided at the top thereof with a cavity 42 within which a magnet 44 is positioned. It will be apparent from FIG. 3 that the element 40 rests on the walls 46 of the member 26 while the shaft 48 thereof extends downwardly through the slot 28 into the groove 36 of the member 34. In this manner, it is possible for the first and second members 26 and 34 to move independently of each other.

Returning to FIG. 2, it will be apparent that the control knob 22 is provided with hubs 50 which are journalled within the walls 52 of the casing 10 permitting the control knob 22 to rotate. In similar manner, the control knob 24 is provided with hubs 54 journalled within the walls 56 of the casing permitting the control knob 24 to rotate. Extending outwardly from the control knob 22 is a shaft 58 which is threaded, and in like manner extending outwardly from control knob 24 is a shaft 66 which is threaded. A flexible, continuous band 62 provided with a continuous rack of teeth 63 is mounted about the threaded shaft 58 and a threaded shaft 64 which is journalled for rotation within the walls 66 of the casing such that as the control knob 22 is maually rotated the band 62 moves. The band 62 is provided with an abutment 68 extending outwardly therefrom which is interposed between the opposed arms 70 extending outwardly from the member 34. Thus, movement of the band 62 in response to rotation of the control knob 22 causes the member 34 to move from side to side. In similar manner, the reference numeral 72 designates a continuous, flexible band wound around the threaded shaft 66 and a threaded shaft 74 which is journalled within the walls 76 of the casing 10. The band 72 is provided with a continuous rack of teeth 74 which mesh with the teeth of the shafts 66 and 74 such that rotation of the control knob 24 causes the band 72 to rotate. The band 72 is provided with an abutment 78 extending outwardly from one surface thereof and positioned between the opposed arms 80 which extend outwardly from the member 26 such that movement of the band 72 causes the member 26 to move up and down, as illustrated in FIG. 2.

Figure 4:
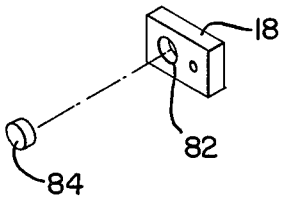
FIG. 4 is a perspective view of the object which moves along the playing surface illustrating the position of the magnet on the underneath side thereof.

The object 18, as illustrated in FIG. 4, is provided along the bottom thereof with a cavity 82 within which a magnet 84 is positioned. It will be apparent that the magnet 44 which is moved by the members 26 and 34 attracts the magnet 84 and thus as the control knobs 22 and 24 are operated the object 18 moves along the path 16 of the playing surface 14. Both single and composite movements of the magnet 44 are possible. Movement of the control knob 22 causes the magnet 44 to move from side to side, whereas movement of the control knob 24 causes the magnet 44 to move up and down. Simultaneous movement of the control knobs 22 and 24 results in a composite of the aforementioned movements thus permitting the magnet 44 to move at any angle across the playing surface 14. In this manner, it is possible for the child with the use of the control knobs 22 and 24 to direct the object 18 along the tortuous path 16 without being stopped by the obstacles 20.

I claim:

1. An amusement device, comprising:

a playing surface provided with a path;

an object provided with a magnet for movement along said playing surface;

a first member mounted to move in one direction below said playing surface;

a second member mounted to move in another direction below said playing surface;

means connecting said first and second members permitting each of said members to move independently of the other;

a magnet, means mounting said magnet to said first and second members;

means controlling the movement of said first and second members;

wherein said means connecting said first and second members comprises a slot provided within one of said members, a groove provided in the other of said members, and an element having a portion thereof extending through said slot into said groove;

wherein said means moving said first and second members comprises control knobs mounted for rotation, continuous flexible bands mounted for movement in directions corresponding to the direction of movement of said members, said control knobs engaging said bands such that as the knobs are manually turned, said bands rotate, and means connecting said members to said bands such that as said bands rotate said members move; and wherein said bands are provided with continuous racks of teeth, said control knobs are provided with shafts provided with teeth engaging said racks of said bands, and said means connecting said members to said bands comprise abutments formed on said bands extending into slots formed at the ends of said members.

* * * * *